US005447345A

United States Patent [19]

Daley

[11] Patent Number: 5,447,345

[45] Date of Patent: Sep. 5, 1995

[54] SECURITY BAR

[76] Inventor: Philip A. Daley, Rte. 2, P.O. Box 310, Ragley, La. 70657

[21] Appl. No.: 170,876

[22] Filed: Dec. 21, 1993

[51] Int. Cl.[6] ..... E05C 19/18

[52] U.S. Cl. ..... 292/259 R; 292/264; 292/289

[58] Field of Search ..... 292/289, 259, 288, 264

[56] References Cited

U.S. PATENT DOCUMENTS

| | | | |
|---|---|---|---|
| 878,294 | 2/1908 | Kleidmann | 292/264 |
| 1,748,598 | 2/1930 | Dermody | 292/259 R X |
| 5,232,254 | 8/1993 | Teaff | 292/259 R |

FOREIGN PATENT DOCUMENTS

| | | | |
|---|---|---|---|
| 14814 | 9/1881 | Germany | 292/259 R |
| 329455 | 11/1920 | Germany | 292/259 R |

OTHER PUBLICATIONS

Phoenix Defender Series 10–40 Sep. 6, 1983.

*Primary Examiner*—Rodney M. Lindsey
*Attorney, Agent, or Firm*—John M. Harrison

[57] ABSTRACT

A security bar assembly for preventing a door connected to a door frame mounted on a wall from being forced open, said security bar assembly including a rigid bar extending horizontally across the width of the door for preventing the door from being opened, a chain or cable connecting the rigid bar to the wall or frame, brackets for connecting the rigid bar to the door frame or wall.

8 Claims, 2 Drawing Sheets

SECURITY BAR

BACKGROUND OF THE INVENTION

1. Field of the Invention

The invention relates to security bars. In particular, the invention relates to security bars for preventing doors from being forced open.

2. Description of the Related Art

Security bars for doors are known in the art. Exemplary of the security bars of the prior art are those disclosed in the following U.S. Patents:

U.S. Pat. No. 5,165,741 discloses a security door bar adapted to prevent the opening of a door by intruders and including a resilient metal bar which carries a polygon shaped block through which pressure is applied to the door, the metal bar being adjustable to the width of the door and the polygon .shaped block being rotatable on the bar to adjust for door thickness and amount of pressure to be applied to the door. The metal bar is adapted to the door by use of a metal screw hook which is screwed into a wall stud on the knob side of the door and pressure is applied to the door from the metal bar through the polygon block and pressure distribution sheet attached to the door.

U.S. Pat. No. 5,014,527 discloses a kickproofer which is a security device to protect a door from forced entry including two brackets, a rigid form and one or more male protrusions. The brackets are securely attached to both sides of a door jamb and secured adjacent and perpendicular to the center line of the keyed lock of the door. The form slides into the brackets, buttressed in place with the male protrusions when the door is closed. An optional embodiment utilizes a plate placed over and blocking access to the locking device of the door.

U.S. Pat. No. 4,796,445 discloses a door locking mechanism for use with an outwardly swinging door including a bar permanently mounted on the inside of the door spanning the width. At each end of the bar is mounted a :locking member in the form of a plate which is rotatable between a first position blocking the door against opening and a second position releasing the door. Padlocks may be employed to lock the plates in either position.

U.S. Pat. No. 4,667,992 discloses a security bar for inwardly swinging doors which is mounted on retainers on each side of the frame of the door. Each retainer has a base surface, the inclination of which can be adjusted relative to the head of the retainer to accommodate door trim that inclines relative to the plane of the frame. The bar has slots on each end for engaging the retainer. One of the slots is parallel with the axis of the bar for sliding over one of the retainers. The other slot is perpendicular to the axis of the bar for sliding downwardly onto the other retainer. A sliding locking plate locks the bar to the retainer once in position. The retainers can be installed on wooden door frames, or on metal door frames. On metal door frames, a placement hole is drilled on the inside of the door frame to insert a barrel nut. A placement tool holds the barrel nut while tightening to a screw extending through the retainer.

U.S. Pat. No. 4,462,625 discloses a safety entry latching arrangement characterized as a pivotal and extendible securing member attached to an existing door hinge assembly secured onto one side of the framework of an entry and selectively connecting to a latch member disposed on the framework at the opposite side of the entry. The securing member is preferably defined by two parts arranged in a slidable telescopic relationship, where spring urged structure serves to maintain the securing member in an outwardly or upwardly extending latching or storage position, respectively. In a typical arrangement, an audible signaling system can be combined with the handle for the securing member to afford additional protection for the user, i.e. to forewarn unwanted entry.

U.S. Pat. No. 3,955,841 discloses a holding bar for a closure such as a door in its locked position or in a partially opened position to enhance security. A bar for holding the closure in either position is provided together with keepers cooperating with the bar to perform the holding function.

U.S. Pat. No. 3,980,330 discloses a safety latch for holding a door in this locked position or in a partially open position to enhance security. A bar for holding the door in either position is provided, together with a swingable keeper cooperating with the bar to perform the holding functions. The holding device for holding the bar in the door locked position is slidably supported on the bar for movement into and out of keeper holding position.

U.S. Pat. No. 2,421,275 discloses a metallic safety bar for doors including a partly tubular member having at one bored end thereof a device for connection with the door frame, whereby the bar is permitted to move in any direction, the device including in a screw which passes through the bored end of the tubular member and through threaded bores formed in the upper and lower branches of a semi-circular forked member secured as by a screw to the jamb to which the door is hinged, the member having inserted in its other end one end of a rod, the rod having integrally secured to its lower portion a projection adapted to cooperate with the bolt of a lock arranged in an inverted horizontal position, so that the projection and consequently the rod will move with the lock bolt.

U.S. Pat. No. 2,163,206 discloses a metal safety bar for doors in combination with a locking-pin secured to the door frame, the bar having at one end thereof a device for connecting it with the door-frame which permit its rotation in two perpendicular planes, and a device slidably mounted on the other end of the bar, the device being connected to the bolt of a door lock and adapted to be detachably connected to the locking-pin, so that the latter device may automatically follow all of the movements of the lock bolt.

U.S. Pat. No. 212,242 discloses an improvement in bar-holders for doors and windows including a folding staple for holding the bar.

SUMMARY OF THE INVENTION

In accordance with the present invention there is provided a security bar assembly for preventing a door connected to a door frame mounted on a wall from being forced open, the security bar assembly including a rigid bar extending horizontally across the width of the door for preventing the door from being opened, a chain or cable connecting the rigid bar to the wall or frame, brackets for connecting the rigid bar to the door frame or wall.

The present invention has the advantage of providing a security bar for preventing forced entry into a room.

The present invention has the further advantage of providing a security bar which is held in a vertical position by a chain when not being used to secure a door.

BRIEF DESCRIPTION OF THE DRAWINGS

The invention will be more fully understood by reference to the drawings in which.

BRIEF DESCRIPTION OF THE PREFERRED EMBODIMENTS

Figure 1:
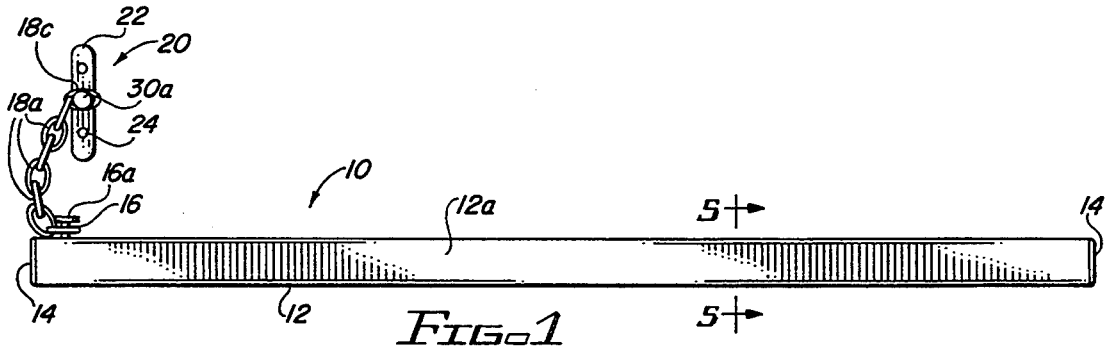
FIG. 1 is a plan view of the security bar assembly of the invention.
Figure 5:
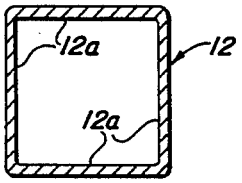
FIG. 5 is a cross-sectional view taken along lines 5—5 of FIG. 1.

Referring now to the drawings, in FIG. 1 is shown the security bar assembly of the invention generally indicated by the numeral 10. Security bar assembly 10 includes a bar 12 having generally rectangular sidewalls 12*a* which is generally rectangular in cross-section, preferably having a square cross-section as shown in FIG. 5. Bar 12 is preferably constructed of a metal such as steel.

Figure 6:
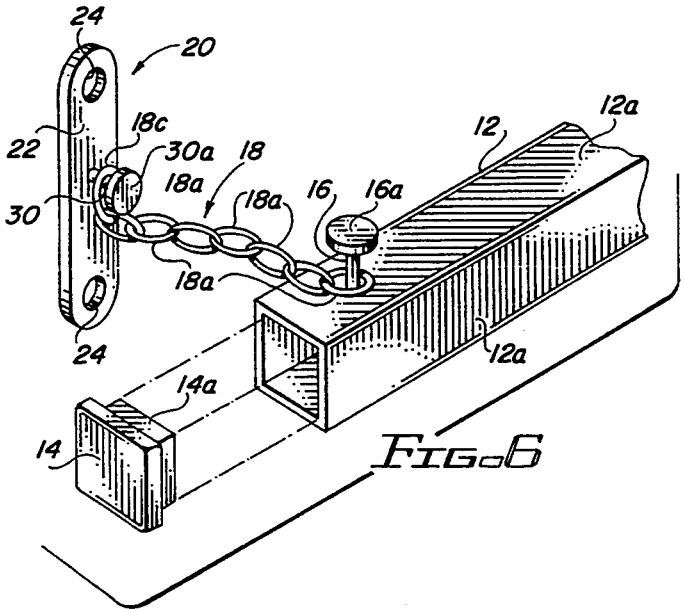
FIG. 6 is a perspective, partly exploded, partly cutaway view of one end of the security bar assembly of the invention.

Preferably bar 12 is hollow as shown in FIG. 5 and has four sidewalls in the shape of a square. Preferably two end caps 14—14 cover each hollow end of bar 12 as shown in FIG. 1. End caps 14—14 have square inserts 14*a* rigidly connected thereto which are force fitted into each end of bar 12 as shown in FIG. 6. End caps 14—14 preferably are made of plastic.

A pin 16 is rigidly connected to one end of bar 12. Pin 16 has a generally circular head 16*a* rigidly connected thereto.

A chain generally indicated by the numeral 18 having inner links 18*a*–18*a* and end links 18*b* and 18*c* is connected to bar 12 by end link 18*b* which is fitted around pin 16 and held on pin 16 by head 16*a*. Head 16*a* is larger in diameter than the inside diameter of link 18*b* to prevent removal of the link 18*b* from pin 16.

Figure 8:
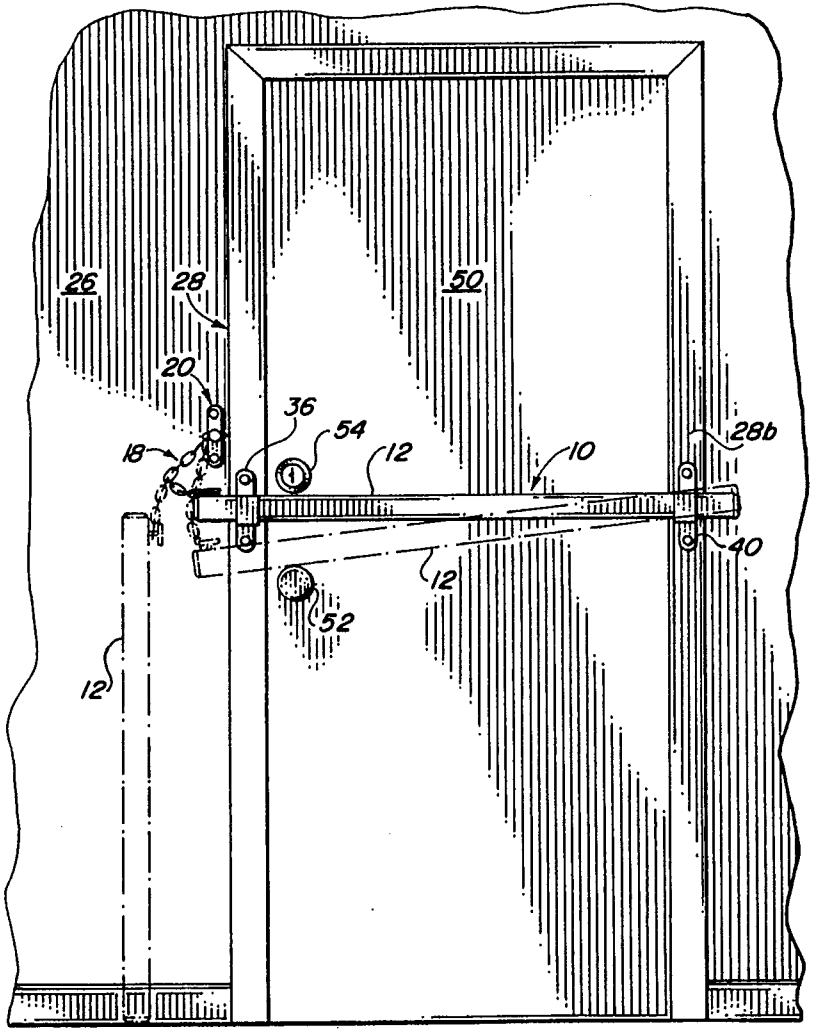
FIG. 8 is an elevational view of a door and door frame having the security bar assembly of the invention connected thereto.
Figure 7:
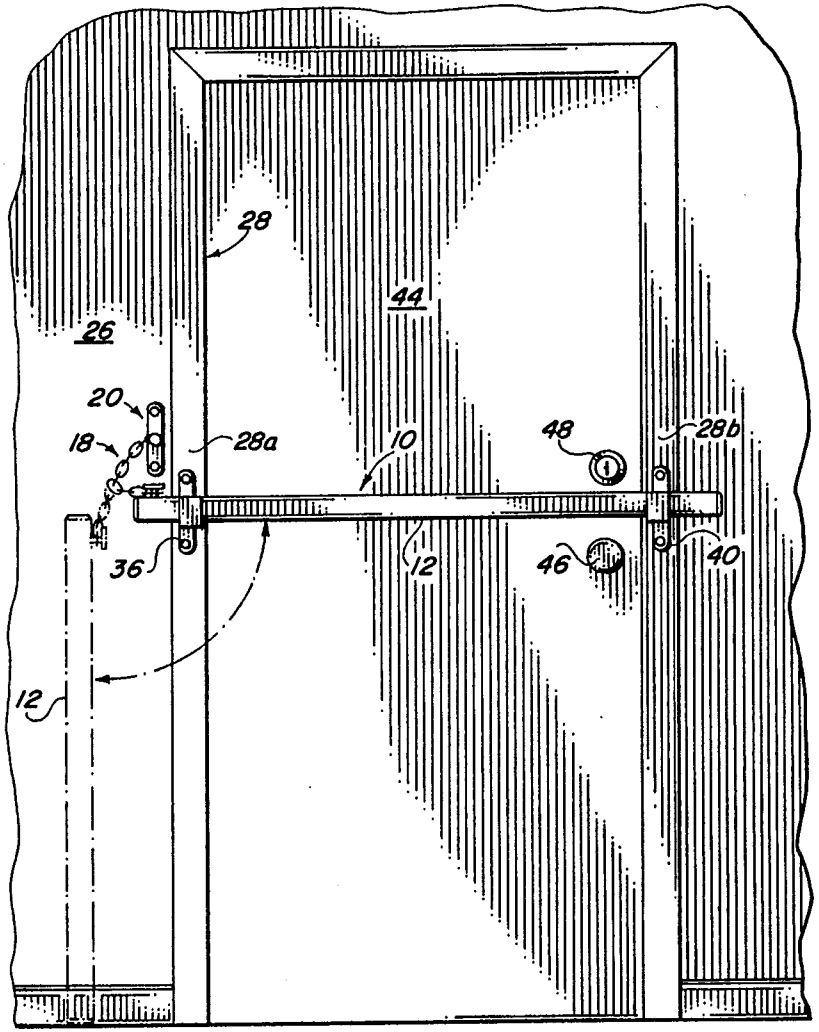
FIG. 7 is an elevational view of a door and door frame having the security bar assembly of the invention connected thereto.

Link 18*c* of chain 18 is connected to the chain plate generally indicated by the numeral 20. Chain plate 20 is a generally rectangular, generally flat plate 22 having screw or bolt receiving holes 24—24 for receipt of screws or bolts for fastening chain plate 20 to an inside wall 26 adjacent to a door frame 28 as shown in FIGS. 7 and 8. Flat plate 22 has a pin 30 rigidly connected thereto, and pin 30 has a generally circular head 30*a* thereon. Chain 18 is connected to flat plate 22 by end link 18*c* which is fitted around pin 30 and held on pin 30 by head 30*a*. Thus bar 12 is tethered to wall 26 by chain 18. Head 30*a* is larger in diameter than the inside diameter of link 18*c* to prevent removal of the link 18*c* from pin 30. Chain 18, chain plate 20, pin 30, and pin head 30*a* are preferably made from a metal such as steel. If desired, chain 18 could be replaced with a strong, flexible cable connected to pin 16 and pin 30, although a chain 18 is preferred.

Bar 12 is received in two brackets generally indicated by the numerals 32 and 34. Bracket 32 is a flat plate 36 having screw or bolt receiving holes 38—38 therein for connecting bracket 32 to the left side 28*a* of door frame 28 as shown in FIGS. 7 and 8. If desired bracket 34 could be connected to the inside wall 26. Bracket 32 also has an "L" shaped receiving member generally indicated by the numeral 32*a*. Receiving member 32*a* has a bottom leg 32*b* rigidly connected perpendicularly to flat plate 36, and a side leg 32*c* rigidly connected perpendicularly to bottom leg 32*b*. Legs 32*b* and 32*c* thus form a "U" shaped channel in which security bar 12 is supported when placed therein. The lengths of legs 32*b* and 32*c* are selected to loosely receive bar 12 therein.

Figure 2:
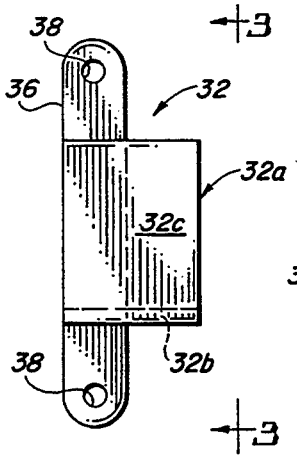
FIG. 2 is a plan view of a bracket used to secure the security bar of the invention to a door frame.
Figure 3:
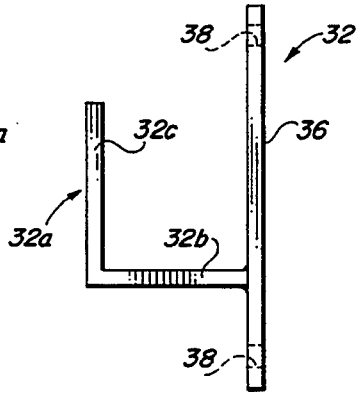
FIG. 3 is an end view of the bracket of FIG. 2 taken along lines 3—3 of FIG. 2.
Figure 4:
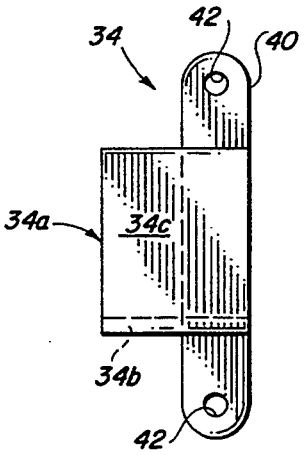
FIG. 4 is a plan view of a bracket used to secure the security bar of the invention to a door frame.

Bracket 34, which is a mirror image of bracket 32 when view from the front as in FIG. 2, is a flat plate 40 having screw or bolt receiving holes 42—42 therein for connecting bracket 34 to the right side 28*b* of door frame 28 as shown in FIGS. 7 and 8. If desired bracket 34 could be connected to the inside wall 26. Bracket 34 also has an "L" shaped receiving member generally indicated by the numeral 34*a*. Receiving member 34*a* has a bottom leg 34*b* rigidly connected perpendicularly to flat plate 40, and a side leg 34*c* rigidly connected perpendicularly to bottom leg 34*b*. Legs 34*b* and 34*c* thus form a "U" shaped channel in which security bar 12 is supported when placed therein. The lengths of legs 34*b* and 34*c* are selected to loosely receive bar 12 therein. Brackets 32 and 34 are preferably made from a metal such as steel.

In FIG. 7, the security bar assembly of the invention is shown attached to the inside of door frame 28 of door 44 having doorknob 46 and conventional key lock 48 on the right hand side thereof, with the hinges (not shown) of door 44 being located on the left side of the door. In FIG. 8, the security bar assembly of the invention is shown attached to the inside of door frame 28 of door 50 having doorknob 52 and conventional key lock 54 on the right hand side thereof, with the hinges (not shown) of door 50 being located on the right side of the door. Both doors 44 and 50 are hinged to swing toward the inside of the room having inside wall 26 and toward bar 12 when the doors are opened, and bar 12 prevents the doors from being opened when bar 12 is in the position shown in FIGS. 7 and 8. In FIG. 8 is shown a preferred embodiment of the invention where the chain 18 is located adjacent to the doorknob 52, the security bar can be removed from bracket 36 only and rested on doorknob 52 to partially open the door 50 to view a person seeking entrance while still providing security from forced entry by the person seeking entrance.

As can be seen in both FIGS. 7 and 8, the security bar 12 is sufficiently long enough to extend completely across the width of the doors 44 and 50 to sides 28*a* and 28*b* of door frame 28. In both FIG. 7 and FIG. 8, the security bar 12 is shown in phantom lines in the position the bar 12 is placed when the doors are to be opened. The chain plate 20 can be seen to be positioned at a height such that the bar 12 is supported in a vertical position when not used to provide additional security for the doors. Thus the security bar assembly of the invention is conveniently and aesthetically held in a vertical position on the wall adjacent to the door frame when not being used to secure a door from forced entry.

Although the preferred embodiments of the invention have been described in detail above, it should be understood that the invention is in no sense limited thereby, and its scope is to be determined by that of the following claims:

What is claimed is:

1. A security bar assembly for securing an inwardly opening door connected to a door frame mounted on a wall and preventing said door from being forced open, said door having a doorknob for selectively opening said door, said security bar assembly comprising:

a. A rigid bar for extending horizontally across the width of said door for preventing said door from being opened, said rigid bar having a connected end and a disconnected end, b. Connecting means for tethering said rigid bar to said wall or said door frame, with one end of said connecting means being connected to said wall or door frame adjacent to said doorknob and the opposite end of said connecting means being connected adjacent to said connected end of said rigid bar, and c. a pair of brackets connected to said door frame or said wall adjacent to said door for removably connecting said rigid bar to said door frame or said wall, whereby said rigid bar may be removed from both of said brackets for fully opening said door and said connected end of said rigid bar may be removed from one of said brackets for partially opening said door a distance proportional to the length of said connecting means.

2. The security bar assembly of claim 1 wherein said rigid bar is generally rectangular in cross-section.

3. The security bar assembly of claim 1 wherein said brackets are generally "U" shaped.

4. The security bar assembly of claim 1 comprising plate means provided on said connecting means for connecting said connecting means to said wall or said door frame.

5. The security bar assembly of claim 4 wherein said connecting means comprises a tether connected to said plate means and said connected end of said rigid bar.

6. The security bar assembly of claim 5 wherein said connected end of said rigid bar is located adjacent to said plate means.

7. The security bar assembly of claim 1 wherein said connecting means for tethering said rigid bar comprises a chain.

8. The security bar assembly of claim 1 wherein said connecting means is located at a height sufficient to hold said rigid bar substantially vertically when said rigid bar is not located in said bracket means.

* * * * *